US007669354B2

(12) United States Patent
Aebischer et al.

(10) Patent No.: US 7,669,354 B2
(45) Date of Patent: Mar. 2, 2010

(54) METHOD AND APPARATUS FOR DETERMINING THE LOADING OF A BUCKET

(75) Inventors: Beat Aebischer, Heerbrugg (CH); Bernhard Braunecker, Rebstein (CH); Kevin Greenwood, Brisbane (AU); Peter Stegmaier, Uetikon a/S (CH)

(73) Assignee: Leica Geosystems AG, Heerbrugg (CH)

( * ) Notice: Subject to any disclaimer, the term of this patent is extended or adjusted under 35 U.S.C. 154(b) by 650 days.

(21) Appl. No.: 11/553,911

(22) Filed: Oct. 27, 2006

(65) Prior Publication Data

US 2008/0005938 A1 Jan. 10, 2008

(30) Foreign Application Priority Data

Oct. 28, 2005 (AU) ..... 2005227398

(51) Int. Cl.
*E02F 5/00* (2006.01)

(52) U.S. Cl. ..... 37/348

(58) Field of Classification Search ..... 37/348, 37/382, 195, 395, 397, 414, 415, 907; 172/2–12; 414/694, 699.697; 701/50
See application file for complete search history.

(56) References Cited

U.S. PATENT DOCUMENTS 4,677,579 A * 6/1987 Radomilovich ..... 702/174
4,809,794 A * 3/1989 Blair et al. ..... 177/139
5,220,968 A * 6/1993 Weber ..... 177/25.14
5,826,666 A * 10/1998 Tozawa et al. ..... 172/7
6,225,574 B1 5/2001 Chang et al.
6,711,838 B2 * 3/2004 Staub et al. ..... 37/348
6,934,616 B2 * 8/2005 Colburn et al. ..... 701/50

FOREIGN PATENT DOCUMENTS

AU A-60276/90 2/1991
SU 1649299 A1 5/1991

* cited by examiner

*Primary Examiner*—Robert E Pezzuto
(74) *Attorney, Agent, or Firm*—Workman Nydegger

(57) ABSTRACT

For determining the load of an excavator bucket, or optionally of another holding region, a measurement step and an evaluation step are carried out. In the measurement step, the position of a load surface is determined by a noncontact distance-measuring device and, in the evaluation step, a load volume is determined from the position of the load surface and the position and shape of the excavator bucket or of the holding region. For determining the position of the load surface, at least one two-dimensional matrix with distance values is created by means of a distance-measuring camera. For determining the position of the excavator bucket, the distances to at least three points of the excavator bucket, in particular to points on the upper bucket edge, optionally to marked points are determined using the distance-measuring apparatus for determining the surface.

23 Claims, 1 Drawing Sheet

METHOD AND APPARATUS FOR DETERMINING THE LOADING OF A BUCKET

BACKGROUND OF THE INVENTION

Construction machines having holding regions, in particular machines for changing a surface with at least one bucket, preferably excavators, in particular heavy cable-operated excavators with large-volume buckets, are used for excavating or removing material. For removing material in open cast mining, for example, bucket wheel excavators which can hold up to 100 metric tons of material in a bucket are used. The excavators can be divided into excavators having an at least two-part arm and buckets arranged displaceably thereon and into cable-operated excavators having at least one boom. In the case of the cable-operated excavators, there are both those in which the bucket hangs from a first cable and is dragged by a second cable and those in which the bucket is fastened to an arm and the cable operates the arm with the bucket. In the case of the excavators having two-part arms, there are those having buckets open at the back and those having buckets open at the front.

In order to avoid overloading when loading giant trucks but nevertheless to achieve as high a load as possible, weight determinations are carried out by the excavators during the filling. Moreover, a measurement of the weight permits calculation of the mass removed.

U.S. Pat. No. 6,225,574 disclose that weight determinations are possible by determining the motor power of bucket drives. These weight determinations are very inexact because they deliver only a total force which is composed of that fraction of the weight to be determined which varies with the bucket movement and of inertial forces which vary with the complicated dynamic movement processes. More exact weight determinations have therefore been proposed. By simultaneous measurement of positions of the excavator structure and loads during a plurality of movement intervals, a loading weight is to be determined with greater accuracy by selection and averaging. By means of the position-measuring series, geometrical and dynamic corrections can be made. At least two sensors must be provided just for an exact determination of the position of the bucket of a cable-operated excavator having a tiltable boom and an arm tiltably fastened thereto and carrying the bucket. Because the excavator is optionally also used on sloping terrain, the determination of the bucket position relative to the pivot joint is more complicated.

The bucket load is determined via the motor power at a steel cable, the steel cable being led from the motor over a pulley to the bucket. In order to be able to derive as accurate a weight component of the bucket load as possible from the measured cable load, the absolute position of the pulley for the steel cable must be taken into account in relation to the absolute position of the bucket, or the orientation of the terrain and the orientation of the boom and of the arm with the bucket. Moreover, the bucket speed and bucket acceleration must also be taken into account.

For a solution according to U.S. Pat. No. 6,225,574, various sensors distributed around the excavator, and a central control, are required. The setup of the measuring system is very complicated and susceptible to faults. In addition, a calibration procedure has to be carried out before operation and selection and averaging steps during operation. A complicated fuzzy logic formulation is required. The operation of the measuring system is complicated. Because the motor power is dependent not only on the bucket load and the instantaneous position and movement of the excavator components but also on the state of the bearings of the moving parts, the accuracy of measurement is also impaired by further parameters which cannot be measured.

The prior art also discloses solutions in which vibrations generated by the load pick-up are measured and weight values are derived therefrom. These measurements are based on the fact that an arm or a boom can be considered as a vibrating system whose vibrations depend on the bucket load. The weight values determined are frequently not sufficiently accurate.

Measuring systems of the loaded truck can also be used for the weight determination but are frequently very inaccurate. Weighers on which the weights of the trucks with and without a load can be determined are also used for the weight determination. The disadvantage of the weighers is that the trucks have to be driven onto the weigher and that an excessive load is not detected until after loading or the truck would have to be continuously monitored during the loading with regard to the load weight, for example in that the loading takes place with a truck standing on a weigher, which is often complicated or unfeasible.

A further problem is the alteration of physical properties, e.g. density or humidity, during production or movement of the material to be loaded. One of the goals is to quantify production—volumes of dirt, ore or soil moved in "bank cubic meters (BCM)", i.e. in situ volume prior to initial blasting. Especially after blasting and after loading into a bucket a "swelling" of the material occurs, so the physical properties of the dirt in a bucked are different to those in situ prior to blasting or processing. The existing BCM volume estimates based on weights alone can be less accurate due to varying properties, especially a varying density.

SUMMARY OF THE INVENTION

It is the object of the invention to provide a simple solution by means of which the load of the bucket or optionally of another holding region can be measured with sufficient accuracy.

A further object of the invention is to provide a solution that is able to deliver more information on physical properties of the material and on production quantities, especially in real time when handling the material and without any need for interrupts.

These objects are achieved or improved by the features of claim 1 and 10 or the dependent claims, respectively. The dependent claims describe alternative or advantageous embodiments.

In achieving the object, it was recognized, in a first inventive step that not only the weight is of interest when measuring the load. In the case of earth movements, not only the weight but also the volume is often of considerable interest. A specific gravity can be derived from weight and volume. Optionally, only a determination of the volume is also required. If, for example, a mining concession or a stripping order is awarded on the basis of a volume, weight determinations of the material removed cannot under certain circumstances be sufficiently accurately converted into a volume. For example, moisture content and bulk density of the material may vary greatly so that very different total weights have to be expected for the same stripped volume. If, moreover, the weight determinations themselves are very inaccurate, volumes derived therefrom would be even more inaccurate.

In a second inventive step, it was recognized that a measuring method should be used which directly determines the respective filling volume of a holding region, in particular of an excavator bucket. After the filling of a bucket, the volume of the material filled can be very accurately determined from the fixed geometry of the bucket interior and the surface of the material filled. For the accurate determination of a surface in the bucket, a noncontact distance measuring device having a signal source and a receiver is arranged in such a way that it is aligned with the bucket interior at least during a segment of movement of the filled bucket.

In the case of a cable-operated excavator, the distance-measuring device is preferably fastened to the boom, optionally to a holder projecting from the free end of the boom. Equally, the method according to the invention can also be used for other earth-moving equipment; this is true in particular for hydraulically operated systems. In the case of an excavator having a two-part arm, the distance-measuring device is preferably arranged on an arm part from where a good view onto a filled bucket is possible.

The distances from the sensor to the bucket or to the surface of the material introduced are measured, for example, by at least one distance sensor which is capable of moving in a scanning pattern or by a distance-measuring apparatus comprising an optical system and a one- or two-dimensional sensor array. In the distance measurement, a one- or two-dimensional matrix with distance values should be created. In order to be able to determine a fill quantity from these distance values, it must be possible to determine the area of the matrix which can be assigned to the material surface and the manner in which the bucket is arranged relative to the measured surface (bucket position).

A surface measurement on the empty bucket is optionally carried out for monitoring or calibration of the distance-measuring apparatus. Using the empty measurement and the associated bucket position, it is possible to check whether the two measurements are in agreement. In the case of differences, the values of the distance-measuring apparatus, its positioning or the determination of the bucket position can be calibrated more exactly or corrected.

With the solution according to the invention, the load of the bucket or optionally of another holding region can be measured with little effort and with high accuracy.

The bucket position can be measured by position determinations, in general for at least three defined points of the bucket. For special excavator types and requirement profiles, however, a smaller number of defined points may permit sufficient accuracy of the position determination. If, for example, the bucket cannot be tilted, for example for design reasons, two defined points or, under favourable conditions, for example in the case of joint-free buckets, even only one defined point, are or is sufficient for the position determination. These position determinations on the bucket can be performed by a position-measuring apparatus separated from the distance-measuring apparatus for measuring the surface, in which case, however, the measurement of the surface and the measurement of the bucket position have to be convertible into a common coordinate system. For this purpose, the orientation of the two measuring apparatuses relative to one another must be known. If, in the case of a bucket wheel excavator, both measuring apparatuses are arranged on the boom or, in the case of an excavator having only a two-part arm, on the same arm part, the relative position and orientation remain constant and therefore need be determined only once.

The bucket position can be determined using a camera which measures the contour of the bucket or the upper bucket edge. The bucket position can be derived from the magnitude and the perspective distortion of the contour or of the edge. A stereo camera is optionally used, from the measurements of which position determinations for the bucket are directly derived.

In the case of a cable-operated excavator having a boom and an arm, the bucket position relative to the boom can also be determined through at least one angle determination. For this purpose, the angle between boom and arm is measured, so that the respective current relative position can be determined from the angle, the position of the distance-measuring apparatus on the boom and the arm length. In the case of excavators having pivot joints between arm and bucket, it is also necessary to carry out an angle determination at this pivot joint.

In the case of excavators having only an arm consisting of at least two parts, it is accordingly necessary to determine the orientation of at least one arm part according to the mounting position of the distance-measuring apparatus. The mounting position of the distance-measuring apparatus must be chosen so that a view onto the bucket is achievable during work. In the case of a backward-directed bucket, mounting on an arm part a distance away from the bucket is preferred. In the case of a bucket open at the front, mounting on the arm part directly adjacent to the bucket is preferred.

The determination of the bucket position can also be carried out directly using the distance-measuring apparatus for measuring the surface. In this case, the distance to at least three points of the bucket, in particular to points on the upper bucket edge, must be determined. This solution is advantageous because it is possible to dispense with a further measuring apparatus. By means of a single measuring apparatus for noncontact measurement of distances in a solid angle, the bucket load can be determined very accurately. In order to be able to determine the bucket position as simply and accurately as possible, optionally at least three points of the bucket are marked by means of a reflector or marks. These reflectors, or marks easily detectable by the measuring apparatus, must be arranged on the bucket in such a way that they are detectable by the measuring apparatus when the bucket is full and are not damaged during work.

In the case of cable-operated excavators having an arm, the reflectors or marks are optionally arranged in the region of the back of the bucket. Because a measuring apparatus or camera fastened to the boom detects the bucket predominantly from the back of the bucket and from the arm, respectively, such recessed reflectors would be readily detectable.

The measuring apparatuses which measure distance values in a spatial region at grid points include devices which, as "range imagers" or "image rangers", are defined in particular as distance-measuring cameras. An "image ranger" or a distance-measuring camera emits light signals in the spatial region to be measured and detects signals scattered back, optionally after passage through an optical system, by means of a one- or two-dimensional sensor array. Each light-sensitive region of the sensor array is coordinated with a direction defined by the optical system. The distance determination is effected for each light-sensitive region by an evaluation of the transit time or of the phase shift.

"Image rangers" may be designed to be compact and easily usable. The prior art discloses, for example, an "image ranger" which is based on a CMOS/CCD image sensor having 124×160 pixels. At a distance of 7.5 m, an accuracy of distance measurement of 5 mm is achieved. The measurable solid angle is +/−15°. If the material surface in the bucket is focused on an array of 32×32 pixels, a volume determination is achievable with great accuracy in the case of a filled bucket.

This is therefore a method of measurement which ensures a very accurate volume measurement using a simple and advantageous sensor.

Of course, the volume determination can also be combined with at least one weight determination according to the prior art (load borne by a drive, determination of the induced vibrations, weight measurement system of the loaded truck and/or weighers). In particular, weight values of at least two methods of measurement can also be processed to give a more accurate weight value. If both a weight value and a volume value are present for the same load, a mean density, or a specific gravity, of the loaded material can be derived therefrom. If it may be assumed that the density differences of different loads are due to different moisture contents, information about the moisture content of the respective load is obtained from the different pairs of values measured.

If a plurality of excavators are working on the same material, both determinations can be made, for example, with a first excavator. At least one conversion factor can be determined from the derived relationship between volume and weight. This conversion factor makes it possible to calculate the other parameters for the further excavators, starting from only one determination—namely the weight or the volume. Because the volume determination according to the invention is associated with little effort, for example, the further excavators can be equipped only with a volume-measuring apparatus. In order to determine the weight values used for optimum loading of trucks, the measured volume values are converted using the conversion factor determined in the case of the first excavator. However, the further excavators can also be used with a pure weight measurement, from which the volume can be determined using the conversion factor. This approach permits, for example, the use of existing devices, without retrofitting, together with a system according to the invention.

Of course, the method of measurement according to the invention is not limited to volume determinations in a bucket. The method of measurement is optionally also used in the case of trucks which are filled with material. In principle, the volume of the material present in the holding region can be determined by means of a method according to the invention, in the case of all construction machines and transport apparatuses having holding regions. If the holding region is not moved relative to the measuring apparatus, it is necessary to determine only the material surface. The position of the holding region is determined only after mounting of the measuring apparatus. In the case of moving holding regions on which the measuring apparatus cannot be mounted at a fixed distance, the solution according to the invention is particularly advantageous because it also enables the position of the holding region to be determined.

BRIEF DESCRIPTION OF THE DRAWINGS

The drawing illustrates the invention on the basis of an embodiment. Therein.

DETAILED DESCRIPTION OF THE DRAWINGS

Figure 1:
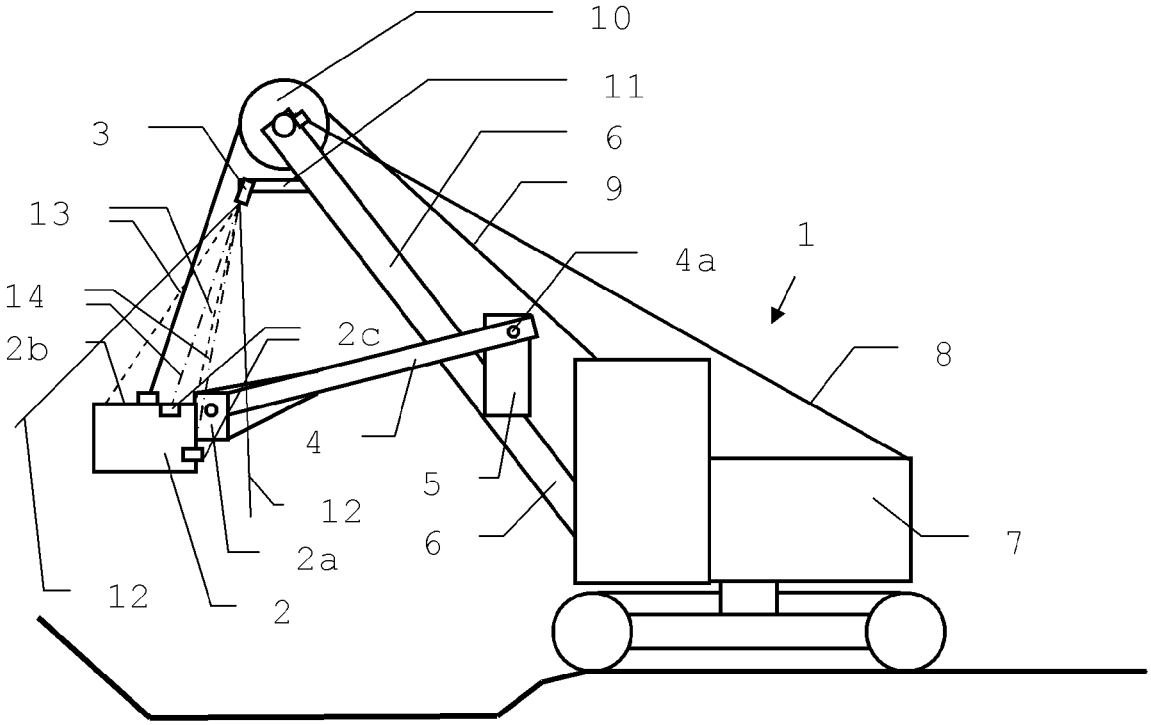
FIG. 1 shows a schematic side view of a cable-operated excavator having a distance-measuring apparatus aligned with the bucket.

FIG. 1 shows a cable-operated excavator 1 having a camera 3 which is aligned with the bucket 2 and measures distances. The bucket 2 is fastened to the free end of an arm 4 by a connecting device 2*a*. The arm 4 is fastened to a boom 6, for example via a pivot joint 4*a* and via a connecting block 5. The boom 6 is fastened to the machine part 7 of the excavator 1 so as to be pivotable about a horizontal axis, and is held in a desired position by first steel cables 8, the first steel cables 8 leading from the free end of the boom 6 to a winch of the machine part 7, which winch is not shown. A pulley 10 is rotatably mounted at the free end of the boom 4. Second steel cables 9 are fastened to the bucket 2 and led over the pulley 10 to a winch of the machine part 7, which winch is not shown. In order to enable the material present in the bucket 2 to leave the bucket 2, for example, the bottom of the bucket is pivotably fastened to a bucket wall, as a discharge member. The bucket 2 is optionally tiltably fastened to the arm 4.

A holder 11 is fastened to the boom 6, and the camera 3 to the holder 11. The camera 3 makes it possible to measure distance values, in segments arranged in the form of a grid, in a spatial region which is represented by first border lines 12. Second border lines 13 indicate the spatial region in which the surface of the material introduced is measurable by the camera 3. The position of the bucket 2 can also be determined with the camera 3 by distance measurements to points of the upper bucket edge 2*b*. At least 3, but preferably two reflectors 2*c* or measuring points each on both sides of the bucket 2, are optionally arranged in that region of the bucket 2 which faces the arm 4. These reflectors 2*c* are arranged in a region of the bucket 2 in which as far as possible no destructive loads occur on receiving material. It would be possible to arrange all reflectors 2*c* in the region of the back of the bucket, i.e. on the side facing the arm 4. To enable the bucket position to be determined as far as possible always and as accurately as possible, connecting lines 14 from the camera 3 to the reflectors 2*d* should not be obstructed by parts of the excavator.

In the measurement step, the position of a load surface in the bucket 2 is determined by means of the noncontact distance-measuring device, preferably the camera 3. In an evaluation step, a load volume is determined from the position of the load surface and the position and shape of the bucket 2 or of the holding region. For the determination of the position of the load surface, at least one two-dimensional matrix with distance values is created. Substantially simultaneously with the determination of the distance values, the position of the bucket 2 is determined, so that the position of the bucket 2 and the surface of the material introduced are available substantially at the same time. This is important for accurate volume determinations in the case of a moving bucket 2.

If the position of the bucket 2 is determined using the camera 3 or the distance-measuring apparatus for measuring the surface, the desired simultaneity is ensured. Distances to at least three points of the bucket 2, in particular to points on the upper bucket edge 2*b*, but optionally to marked points 2*c*, are measured using the camera 3. The distance values of the camera 3 are transmitted to an evaluation control, which is not shown. The evaluation control may be present in the excavator control or optionally at a monitoring station for the entire mining area. The transmission of the data is effected via a cable connection or via a wireless link. If a monitoring station sums all load volumes of the excavator buckets 2 operating in the mining area, the total mined volume is known.

If weight values determined according to the prior art are also transmitted to the evaluation control, and the evaluation control determines both a load volume and a load weight, at least one conversion factor or a value for the specific gravity or, where the specific gravity is known, a value for the moisture content of material on the bucket 2 can be determined from the comparison of the two load values. Of course, a plurality of values determined on the basis of individual bucket loads can be used for statistical evaluations, in particular for mean value calculation.

An apparatus for determining the load of an excavator bucket 2 comprises a noncontact distance-measuring device, in particular a distance-measuring camera 3, and an evaluation control, the distance-measuring device making it possible to feed at least one one-dimensional, but preferably one two-dimensional, matrix with distance values to the evaluation control. The evaluation control determines a load volume from the distance values and the position and shape of a holding region, in particular of an excavator bucket 2. Of course, the apparatus according to the invention can also be used in other construction machines having holding regions for holding material. It can particularly advantageously be used in the case of devices in which the distance-measuring device cannot be arranged at a fixed distance from the holding region.

What is claimed is:

1. A method for determining the load of at least one of a bucket and holding region of a machine for surface modification, the method comprising:

in a measurement step, determining at least one measured value; and in an evaluation step, determining a load value from the at least one measured value, wherein, in the measurement step, a surface of material inside at least one of the bucket and the holding region is determined by means of a noncontact distance-measuring device and, in the evaluation step, a load volume is determined from the surface of material inside at least one of the bucket and the holding region and the position and shape of at least one of the bucket and of the holding region.

2. The method according to claim 1, wherein at least one two-dimensional matrix with distance values is created for determining the surface of material inside the at least one bucket and holding region.

3. The method according to claim 2, wherein the method is carried out for a cable-operated excavator having a boom, the noncontact distance-measuring device being connected to the boom and the distance values being transmitted to an evaluation control.

4. The method according to claim 3, wherein weight values are also transmitted to the evaluation control, and the evaluation control determines a load volume, including at least one of the specific gravity, a conversion factor, and a moisture content.

5. The method according to claim 2, wherein the method is carried out for an excavator having an at least two-part arm, at a free end of which the bucket is displaceably fastened, the noncontact distance-measuring device being connected to a part of the arm and the distance values being transmitted to an evaluation control.

6. The method according to claim 5, wherein weight values are also transmitted to the evaluation control, and the evaluation control determines a load volume, including at least one of the specific gravity, a conversion factor, and a moisture content.

7. The method according to claim 1, wherein the position of the bucket is detected when determining the surface of material inside at least one of the bucket and holding region.

8. The method according to claim 7, wherein a calibration step is carried out on an empty bucket, in which calibration step comprises determining the position of the inner surface of the bucket by a measurement step for determining the surface of material inside at least one of the bucket and holding region.

9. The method according to claim 8, wherein the calibration step further comprises optionally deriving at least one correction value for determining at least one of the position of load surfaces and the position of the bucket from the position of the inner surface of the bucket and the position of the bucket.

10. The method according to claim 7, wherein determining the position of the bucket by means of the distance-measuring device for determining the surface of material inside at least one of the bucket and holding region, further comprises determining the distances to at least one point of the bucket, including at least one of a point on the upper bucket edge and to a marked point.

11. The method according to claim 7, wherein determining the position of the bucket further comprises carrying out at least one angle determination between excavator parts using an image, and the bucket position is derived on the basis of image information which is associated with the bucket.

12. The method according to claim 11, wherein determining the position of the bucket further comprises recording the image by means of at least one camera, the image being a stereo image.

13. The method according to claim 1, wherein the method is carried out for a cable-operated excavator having a boom, the noncontact distance-measuring device being connected to the boom and the at least one measured value being transmitted to an evaluation control.

14. The method according to claim 13, wherein weight values are also transmitted to the evaluation control, and the evaluation control determines a load volume, including at least one of the specific gravity, a conversion factor, and a moisture content.

15. The method according to claim 1, wherein the method is carried out for an excavator having an at least two-part arm, at a free end of which the bucket is displaceably fastened, the noncontact distance-measuring device being connected to a part of the arm and the at least one measured value being transmitted to an evaluation control.

16. The method according to claim 15, wherein weight values are also transmitted to the evaluation control, and the evaluation control determines a load volume, including at least one of the specific gravity, a conversion factor, and a moisture content.

17. An apparatus for determining the load of at least one of a bucket and holding region of a machine for surface modification, the apparatus comprising:

a noncontact distance-measuring device and an evaluation control, the distance-measuring device being configured to feed at least one of a one-dimensional and two-dimensional matrix with distance values to the evaluation control, and the evaluation control being configured to determine a load volume from the distance values and the position and shape of at least one of the bucket and the holding region.

18. The apparatus according to claim 17, wherein the distance-measuring apparatus for determining the surface of material inside at least one of the bucket and holding region is configured to measure the distances to at least one point of the bucket including at least one of a point on an upper bucket edge and to a marked point, and to feed the distances to the evaluation control.

19. The apparatus according to claim 17, wherein the distance-measuring apparatus for determining the surface of material inside at least one of the bucket and holding region is a distance-measuring camera.

20. The apparatus according to claim 17, further comprising an angle sensor for deriving the position of the bucket from an angle determination between excavator parts.

21. The apparatus according to claim 17, wherein the distance measuring apparatus for determining the surface of material inside at least one of the bucket and holding region includes at least one of a CMOS image sensor and a CCD image sensor.

22. The apparatus according to claim 17, further comprising a camera for deriving the position of the bucket on the basis of image information.

23. The apparatus according to claim 22, wherein the camera is a stereo camera.

* * * * *